US009666997B1

(12) United States Patent
Henry et al.

(10) Patent No.: US 9,666,997 B1
(45) Date of Patent: May 30, 2017

(54) GASKET PLATE FOR A RECEPTACLE ASSEMBLY OF A COMMUNICATION SYSTEM

(71) Applicant: TYCO ELECTRONICS CORPORATION, Berwyn, PA (US)

(72) Inventors: Randall Robert Henry, Harrisburg, PA (US); Michael John Phillips, Camp Hill, PA (US); Brandon Michael Matthews, McAlisterville, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/069,091

(22) Filed: Mar. 14, 2016

(51) Int. Cl.
*H01R 13/648* (2006.01)
*H01R 13/659* (2011.01)
*H01R 13/518* (2006.01)

(52) U.S. Cl.
CPC ..... *H01R 13/659* (2013.01); *H01R 13/518* (2013.01)

(58) Field of Classification Search
CPC ... H01R 13/648; H01R 13/659; H01R 13/518
USPC ..... 439/607.01, 607.17–607.19
See application file for complete search history.

(56) References Cited

U.S. PATENT DOCUMENTS

| | | | | |
|---|---|---|---|---|
| 5,961,350 | A | 10/1999 | Shiu | |
| 6,893,293 | B2 | 5/2005 | Ice et al. | |
| 8,393,917 | B2 | 3/2013 | Regnier | |
| 8,449,331 | B2 | 5/2013 | Phillips et al. | |
| 8,864,523 | B2 | 10/2014 | Banakis et al. | |
| 9,142,910 | B2 * | 9/2015 | Yu | H01R 13/11 |
| 9,142,922 | B2 | 9/2015 | Regnier et al. | |
| 9,484,678 | B1 * | 11/2016 | Briant | H01R 13/659 |

* cited by examiner

*Primary Examiner* — Khiem Nguyen

(57) ABSTRACT

A connector module assembly includes a plurality of communication connectors arranged side-by-side and secured together as a communication module. Each communication connector has a contact array arranged within a shroud at a mating interface mated with a corresponding pluggable module. The connector module assembly includes a gasket plate coupled to the communication module having at least one sheet positioned between the communication module and the pluggable modules and spanning across and between each of the communication modules. The gasket plate has a plurality of openings receiving corresponding shrouds. The gasket plate has pluggable module interfaces around each of the openings for interfacing with mating ends of the pluggable modules. The gasket plate is conductive to provide EMI shielding at the pluggable module interfaces.

20 Claims, 14 Drawing Sheets

GASKET PLATE FOR A RECEPTACLE ASSEMBLY OF A COMMUNICATION SYSTEM

BACKGROUND OF THE INVENTION

The subject matter described herein relates to communication systems.

At least some known communication systems include receptacle assemblies, such as input/output (I/O) connector assemblies, that are configured to receive a pluggable module and establish a communicative connection between the pluggable module and an electrical connector of the receptacle assembly. As one example, a known receptacle assembly includes a receptacle housing that is mounted to a circuit board and configured to receive a small form-factor (SFP) pluggable transceiver. The receptacle assembly includes an elongated cavity that extends between an opening of the cavity and an electrical connector that is disposed within the cavity and mounted to the circuit board. The pluggable module is inserted through the opening and advanced toward the electrical connector in the cavity. The pluggable module and the electrical connector have respective electrical contacts that engage one another to establish a communicative connection. Conventional communication systems may include multiple cavities and communication connectors for mating with multiple pluggable modules.

Challenges often encountered in the design of the communication system involve dissipating heat generated during operation of the communication system and minimizing electromagnetic interference (EMI), as both heat and EMI negatively affect module/system reliability and electrical performance. Heat dissipation is enhanced by increasing airflow through the components, such as by including openings to allow airflow. In contrast, EMI is reduced by adding shielding in the form of conductive panels that cover or shield the components. Providing openings in the conductive panels to enhance heat dissipation negatively affects shielding effectiveness. A balance between the competing design interests must be met, while maintaining a small form factor. One solution to enhancing heat dissipation is to enlarge the opening or port to the cavity that holds the pluggable module to increase airflow over the pluggable module. However, to provide a larger port, EMI shielding components, typically arranged at the port, are relocated within the receptacle housing to a location at the mating end of the pluggable module. Providing effective shielding at the mating interfaces has been problematic.

Accordingly, there is a need for a communication system design that provides reliable EMI shielding at the mating interface between pluggable modules and the corresponding communication connectors within the receptacle housing.

BRIEF DESCRIPTION OF THE INVENTION

In an embodiment, a connector module assembly is provided including a plurality of communication connectors arranged side-by-side and secured together as a communication module. Each communication connector has a contact array arranged within a shroud at a mating interface. The shroud and contact array are configured for mating with a corresponding pluggable module. The connector module assembly includes a gasket plate coupled to the communication module. The gasket plate has at least one sheet including a front side facing the pluggable modules and a rear side facing the communication module such that the gasket plate is generally positioned between the communication module and the pluggable modules. The at least one sheet spans across and between each of the communication modules. The gasket plate has a plurality of openings receiving corresponding shrouds such that the shrouds pass through the openings for mating with the corresponding pluggable modules. The gasket plate has pluggable module interfaces around each of the openings for interfacing with mating ends of the pluggable modules associated with the corresponding openings. The gasket plate is conductive to provide electromagnetic interference (EMI) shielding at the pluggable module interfaces.

In another embodiment, a receptacle assembly is provided including a receptacle housing and a connector module assembly. The receptacle housing includes a plurality of panels defining a housing cavity. The panels include interior panels dividing the housing cavity into a plurality of module cavities each configured to receive a corresponding pluggable module therein. The module cavities are arranged in a plurality of rows and a plurality of columns. The panels are conductive to provide electromagnetic interference (EMI) shielding for the housing cavity. The connector module assembly is received in the housing cavity and includes a plurality of communication connectors arranged side-by-side and secured together as a communication module. Each communication connector has a contact array arranged within a shroud at a mating interface. The shroud and contact array are aligned with a corresponding module cavity and configured for mating with a corresponding pluggable module. A gasket plate is coupled to the communication module and positioned behind the interior panels. The gasket plate has at least one sheet including a front side facing the module cavities and a rear side facing the communication module such that the gasket plate is generally positioned between the communication module and the pluggable modules. The at least one sheet spans across each of the module cavities and spans across and between each of the communication modules. The gasket plate has a plurality of openings aligned with corresponding module cavities and receiving corresponding shrouds such that the shrouds pass through the openings into the corresponding module cavities for mating with the pluggable modules. The gasket plate has pluggable module interfaces around each of the openings for interfacing with mating ends of the pluggable modules associated with the corresponding openings. The gasket plate is conductive to provide EMI shielding at the pluggable module interfaces, the gasket plate being is mechanically and electrically connected to the receptacle housing.

In a further embodiment, a communication system is provided including pluggable modules each including a pluggable body extending between a mating end and a cable end. The pluggable module has an internal circuit board held in the pluggable body and provided at an end of a cable communicatively coupled to the internal circuit board. The communication system includes a receptacle assembly having a receptacle housing mounted to a circuit board. The receptacle assembly includes a receptacle housing and a connector module assembly received in the receptacle housing. The receptacle housing has a plurality of panels defining a housing cavity. The panels include interior panels dividing the housing cavity into a plurality of module cavities receiving corresponding pluggable modules therein arranged in a plurality of rows and a plurality of columns. The panels are conductive to provide electromagnetic interference (EMI) shielding for the housing cavity. The connector module assembly has a plurality of communication connectors arranged side-by-side and secured together as a communication module. Each communication connector has a contact array arranged within a shroud at a mating interface. The shroud and contact array are aligned with a corresponding module cavity and mated with a corresponding pluggable module. The connector module assembly has a gasket plate coupled to the communication module and positioned behind the interior panels. The gasket plate has at least one sheet including a front side facing the module cavities and a rear side facing the communication module such that the gasket plate is generally positioned between the communication module and the pluggable modules. The sheet spans across each of the module cavities and across and between each of the communication modules. The gasket plate has a plurality of openings aligned with corresponding module cavities and receiving corresponding shrouds such that the shrouds pass through the openings into the corresponding module cavities for mating with the pluggable modules. The gasket plate has pluggable module interfaces around each of the openings for interfacing with the mating ends of the pluggable modules. The gasket plate is conductive to provide EMI shielding at the pluggable module interfaces. The gasket plate is mechanically and electrically connected to the receptacle housing.

DETAILED DESCRIPTION OF THE INVENTION

Embodiments set forth herein include communication systems providing electromagnetic interference (EMI) shielding and significant thermal transfer for the components thereof. Various embodiments of the communication system provide EMI shielding at the interface between pluggable modules and corresponding communication connectors. Various embodiments of the communication system provide a receptacle housing or cage that allows significant airflow therethrough while maintaining EMI shielding in a robust and compact design. Various embodiments of the communication system include multiple communication connectors stacked and ganged together in a dense package while providing EMI shielding for the interfaces between the communication connectors and the pluggable modules.

Unlike conventional systems that utilize gaskets or other shielding features at the entrance to the ports, embodiments set forth herein provide EMI shielding at the mating interface between the pluggable modules and the communication connectors allowing the ports to be open defining air channels at the ports. In various embodiments, the EMI shields are movable within the receptacle housing for mating with the pluggable modules and to provide mating tolerance.

Figure 1:
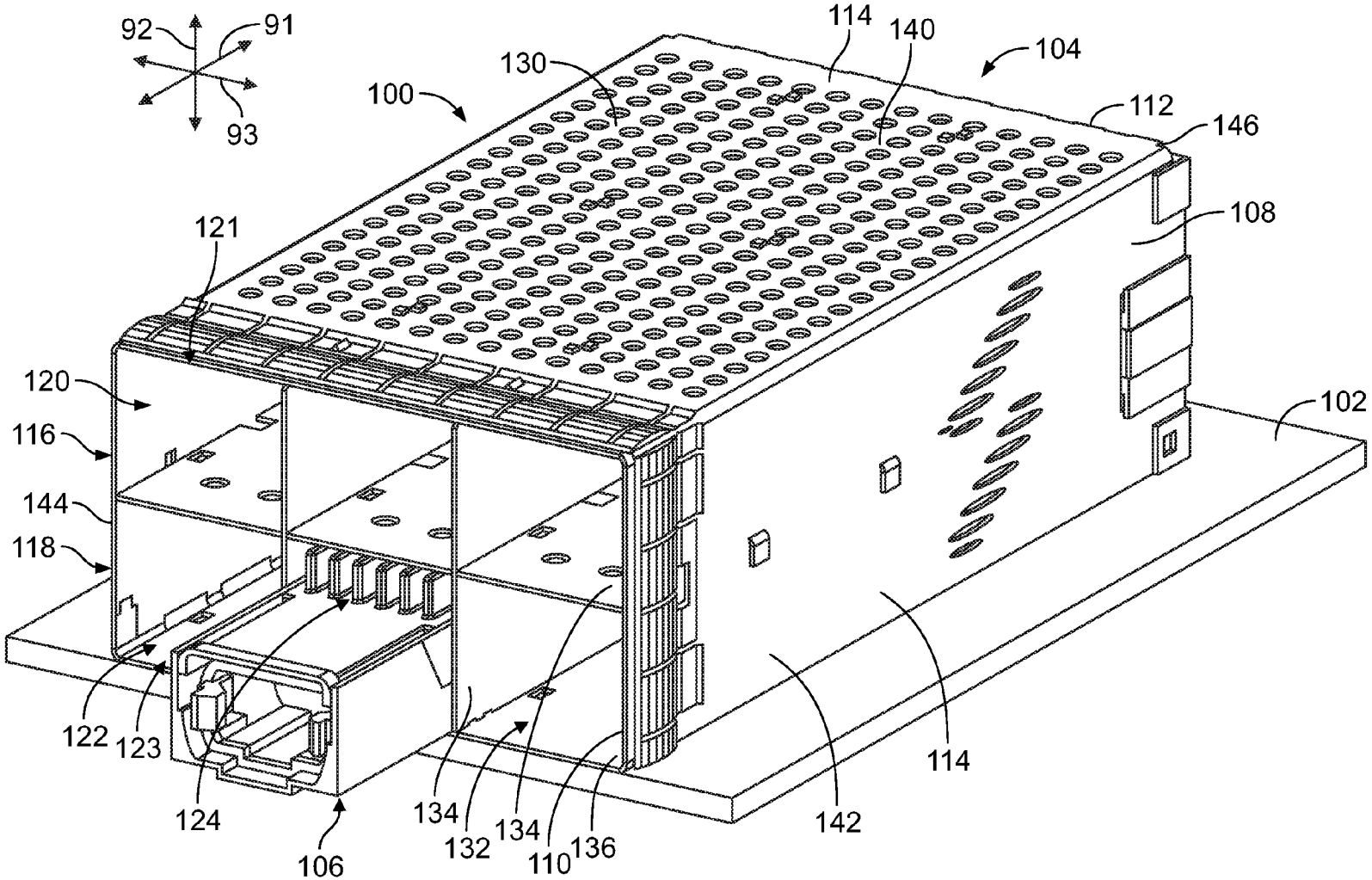
FIG. 1 is a perspective view of a communication system in accordance with an embodiment.

FIG. 1 is a perspective view of a communication system 100 in accordance with an embodiment. The communication system 100 may include a circuit board 102, a receptacle assembly 104 mounted to the circuit board 102, and one or more pluggable modules 106 that are configured to communicatively engage the receptacle assembly 104. The communication system 100 is oriented with respect to a mating or insertion axis 91, an elevation axis 92, and a lateral axis 93. The axes 91-93 are mutually perpendicular. Although the elevation axis 92 appears to extend in a vertical direction parallel to gravity in FIG. 1, it is understood that the axes 91-93 are not required to have any particular orientation with respect to gravity. Moreover, only one pluggable module 106 is shown in FIG. 1, but it is understood that multiple pluggable modules 106 may simultaneously engage the receptacle assembly 104.

The communication system 100 may be part of or used with telecommunication systems or devices. For example, the communication system 100 may be part of or include a switch, router, server, hub, network interface card, or storage system. In the illustrated embodiment, the pluggable module 106 is configured to transmit data signals in the form of electrical signals. In other embodiments, the pluggable module 106 may be configured to transmit data signals in the form of optical signals. The circuit board 102 may be a daughter card or a mother board and include conductive traces (not shown) extending therethrough.

The receptacle assembly 104 includes a receptacle housing 108 that is mounted to the circuit board 102. The receptacle housing 108 may also be referred to as a receptacle cage. The receptacle housing 108 may be arranged at a bezel or faceplate (not shown) of a chassis of the system or device, such as through an opening in the faceplate. As such, the receptacle housing 108 is interior of the device and corresponding faceplate and the pluggable module(s) 106 is loaded into the receptacle housing 108 from outside or exterior of the device and corresponding faceplate.

The receptacle housing 108 includes a front end 110 and an opposite back end 112. The front end 110 may be provided at, and extend through an opening in, the faceplate. The mating axis 91 may extend between the front and back ends 110, 112. Relative or spatial terms such as "front," "back," "top," or "bottom" are only used to distinguish the referenced elements and do not necessarily require particular positions or orientations in the communication system 100 or in the surrounding environment of the communication system 100. For example, the front end 110 may be located in or facing a back portion of a larger telecommunication system. In many applications, the front end 110 is viewable to a user when the user is inserting the pluggable module 106 into the receptacle assembly 104.

The receptacle housing 108 is configured to contain or block electromagnetic interference (EMI) and guide the pluggable module(s) 106 during a mating operation. To this end, the receptacle housing 108 includes a plurality of conductive housing walls 114 that are interconnected with one another to form the receptacle housing 108. The housing walls 114 may be formed from a conductive material, such as sheet metal and/or a polymer having conductive particles. In the illustrated embodiment, the housing walls 114 are stamped and formed from sheet metal. In some embodiments, the receptacle housing 108 is configured to facilitate airflow through the receptacle housing 108 to transfer heat (or thermal energy) away from the receptacle assembly 104 and pluggable module(s) 106. The air may flow from inside the receptacle housing 108 (for example, behind the faceplate) to the external environment (for example, forward of the faceplate) or from outside the receptacle housing 108 into the interior of the receptacle housing 108. Fans or other air moving devices may be used to increase airflow through the receptacle housing 108 and over the pluggable module(s) 106. The housing walls 114 may include openings to allow airflow therethrough. The openings may be sized small enough such that the housing walls 114 provide effective EMI shielding.

In the illustrated embodiment, the receptacle housing 108 includes a first (or upper) row 116 of elongated module cavities 120 and a second (or lower) row 118 of elongated module cavities 122. Each of the module cavities 120, 122 extends between the front and back ends 110, 112. The module cavities 120, 122 have respective openings or ports 121, 123 that are sized and shaped to receive corresponding pluggable modules 106. The module cavities 120, 122 may have the same or similar dimensions and extend lengthwise in a direction that is parallel to the mating axis 91. In the illustrated embodiment, each upper module cavity 120 is stacked over a corresponding lower module cavity 122 such that the lower module cavity 122 is positioned between the upper module cavity 120 and the circuit board 102. In an exemplary embodiment, the module cavities 120, 122 are arranged in a plurality of columns. Any number of module cavities may be provided including a single row and/or a single column of module cavities.

The housing walls 114 of the receptacle housing 108 may form separator plates between the module cavities 120, 122. The separator plates may extend generally parallel to the mating axis 91 at least partially between the front end 110 and the back end 112. In an exemplary embodiment, the module cavities 120, 122 include airflow channels 124 at the front end 110 to allow airflow therethrough along the pluggable modules 106, such as along top surfaces of the pluggable modules 106, to enhance heat transfer of the pluggable modules 106 located in the module cavities 120, 122.

The receptacle housing 108 is formed from a plurality of interconnected panels or sheets. For example, the receptacle housing 108 includes a main panel or shell 130 that surrounds a housing cavity 132, a plurality of interior panels 134 and a base panel 136. The base panel 136 may rest on the circuit board 102. The main panel 130, the interior panels 134, and the base panel 136 may be stamped and formed from sheet metal. The main panel 130, the interior panels 134, and the base panel 136 are assembled to form the module cavities 120, 122. In an exemplary embodiment, the main panel 130 includes a top wall 140, sidewalls 142, 144, and a back wall 146 formed integral with each other; however any of such walls may be separate and coupled to the other walls. The interior panels 134 are configured to be positioned within the housing cavity 132. The interior panels 134 apportion or divide the housing cavity 132 into the separate module cavities 120, 122.

The main panel 130, the interior panels 134, and the base panel 136 may comprise conductive material, such as metal. When the receptacle housing 108 is mounted to the circuit board 102, the receptacle housing 108 and the receptacle assembly 104 are electrically coupled to the circuit board 102 and, in particular, to ground planes (not shown) within the circuit board 102 to electrically ground the receptacle housing 108 and the receptacle assembly 104. As such, the receptacle assembly 104 may reduce EMI leakage that may negatively affect electrical performance of the communication system 100.

The pluggable module 106 is an input/output (I/O) module configured to be inserted into and removed from the receptacle assembly 104. The pluggable module 106 is configured to be inserted into the module cavity 122 of the receptacle housing 108 and advanced in a mating direction along the mating axis 91. In some embodiments, the pluggable module 106 is a small form-factor pluggable (SFP) transceiver or quad small form-factor pluggable (QSFP) transceiver. The pluggable module 106 may satisfy certain technical specifications for SFP or QSFP transceivers, such as Small-Form Factor (SFF)-8431. In some embodiments, the pluggable module 106 is configured to transmit data signals up to 2.5 gigabits per second (Gbps), up to 5.0 Gbps, up to 10.0 Gbps, or more. By way of example, the receptacle assembly 104 and the pluggable module 106 may be similar to the receptacle cages and transceivers, respectively, which are part of the SFP+ product family available from TE Connectivity.

The receptacle assembly 104 includes a connector module assembly 148 (shown in FIG. 3) at the back end 112. The pluggable module(s) 106 is mated with the connector module assembly 148. In an exemplary embodiment, EMI shielding is provided at the connector module assembly to provide electrical shielding at the interface with the pluggable modules 106. For example, one or more gaskets may be provided at the mating interfaces. The EMI shielding is electrically connected to the conductive housing walls 114 to electrically common the EMI shielding of the connector module assembly 148 with the other portions of the receptacle housing 108.

Figure 2:
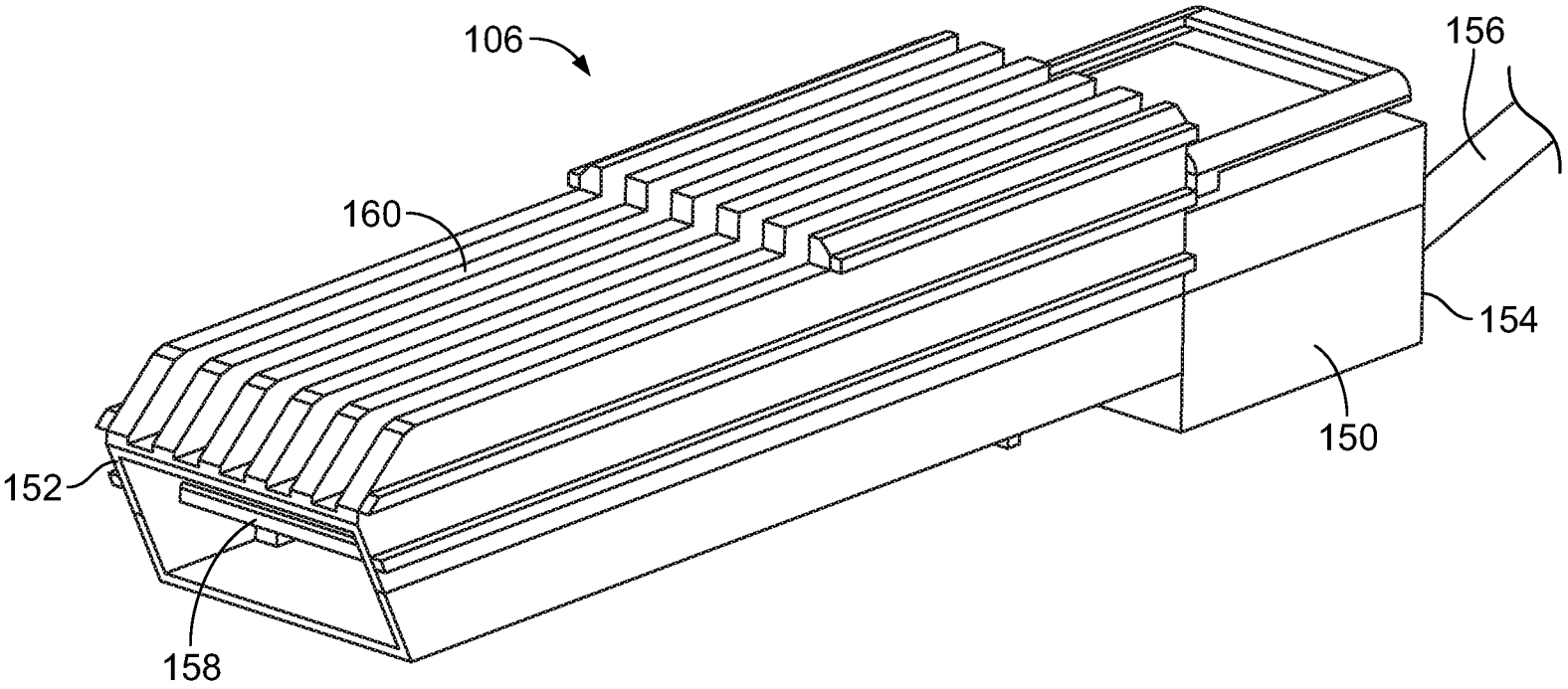
FIG. 2 is a perspective view of a pluggable module for the communication system shown in FIG. 1 in accordance with an exemplary embodiment.

FIG. 2 is a perspective view of the pluggable module 106 in accordance with an exemplary embodiment. In some embodiments, the pluggable module 106 is an input/output cable assembly having a pluggable body 150. The pluggable body 150 includes a mating end 152 and an opposite cable end 154. A cable 156 is coupled to the pluggable body 150 at the cable end 154. The pluggable body 150 also includes an internal circuit board 158 that is communicatively coupled to electrical wires or optical fibers (not shown) of the cable 156. The internal circuit board 158 may be exposed at the mating end 152 for mating with the connector module assembly 148 (shown in FIG. 3). The cable 156 may be communicatively coupled by directly terminating the wires to the internal circuit board 158, such as by soldering the wires to the internal circuit board. Alternatively, the cable 156 may be communicatively coupled by other processes, such as by using connectors at the end of the cable 156 and on the internal circuit board 158. The internal circuit board 158 is supported by the pluggable body 150.

In an exemplary embodiment, the pluggable body 150 is manufactured from a conductive material, such as a metal material. The pluggable body 150 provides EMI shielding for the circuit board 158. Optionally, the pluggable body 150 may provide heat transfer for the internal circuit board 158, such as for the electronic components on the internal circuit board 158. For example, the internal circuit board 158 is in thermal communication with the pluggable body 150 and the pluggable body 150 transfers heat from the internal circuit board 158. In an exemplary embodiment, the heat is transferred from at or near the mating end 152, such as where various electrical components are located on the internal circuit board 158, to the cable end 154. The heat is pulled out of the receptacle assembly 104 and mating end 152 and rejected to the external environment forward of the faceplate. In other embodiments, the heat may be drawn into other portions of the pluggable body 150 and/or the heat may be directed to other portions of the pluggable body 150, such as to the mating end 152 where the heat may be transferred to another heat sink or heat transferring component inside the chassis.

In an exemplary embodiment, the pluggable body 150 includes a plurality of fins 160 extending therefrom. The fins 160 increase the surface area of the pluggable body 150 and allow greater heat transfer therefrom. The fins 160 may extend from any portion of the pluggable body 150, such as the top, the sides and/or the bottom. In the illustrated embodiment, the fins 160 are parallel plates with airflow channels therebetween. The plates may extend continuously between opposite ends of the fins 160. In alternative embodiments, other types of fins 160 may be used, such as fins 160 in the form of pins or posts extending from the pluggable body 150. The pin shaped fins 160 may be arranged in rows and columns and may be separated from each other to allow airflow around the pins and between the various pins.

Figure 3:
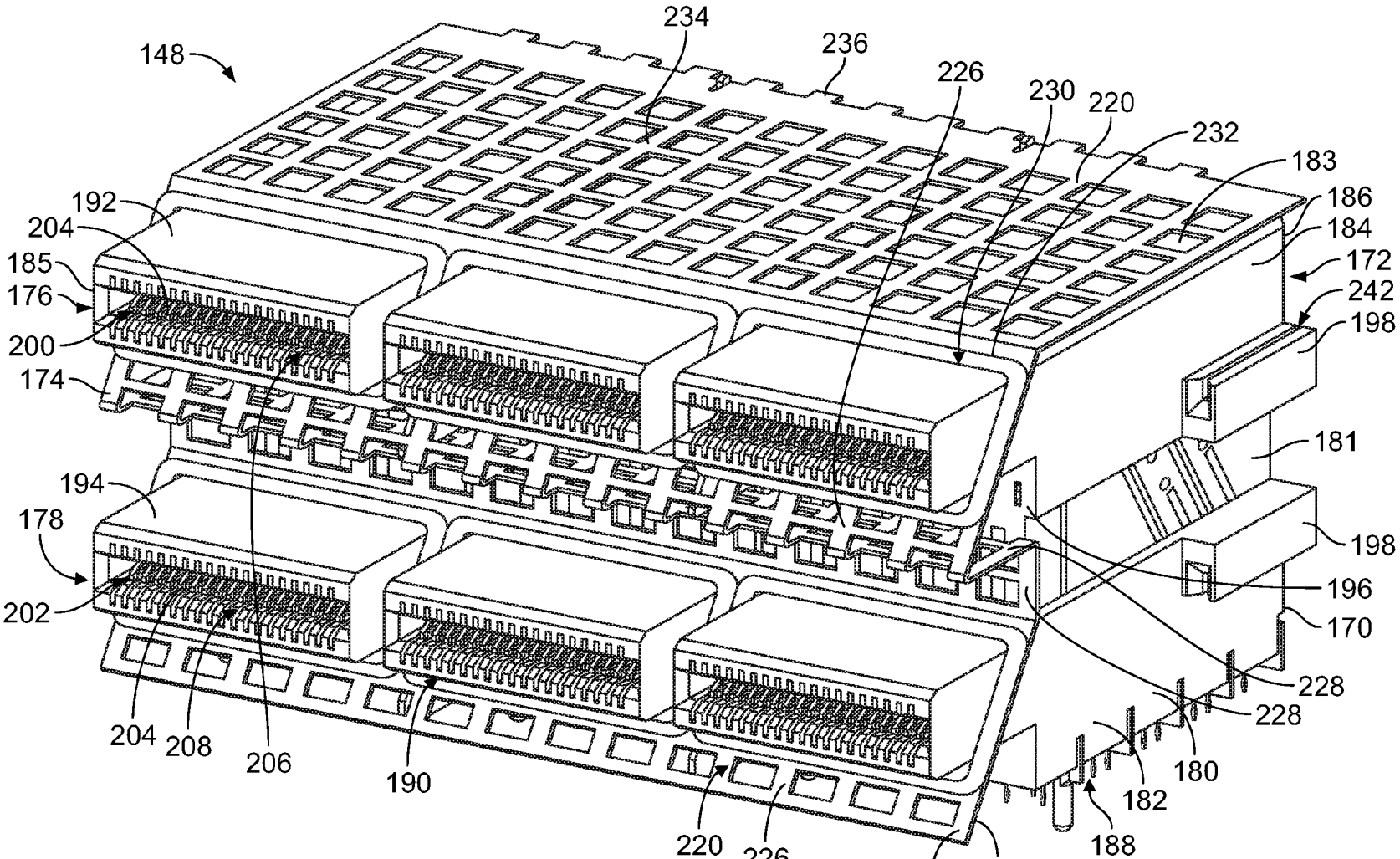
FIG. 3 is a front perspective view of a connector module assembly for the communication system shown in FIG. 1 in accordance with an exemplary embodiment.
Figure 4:
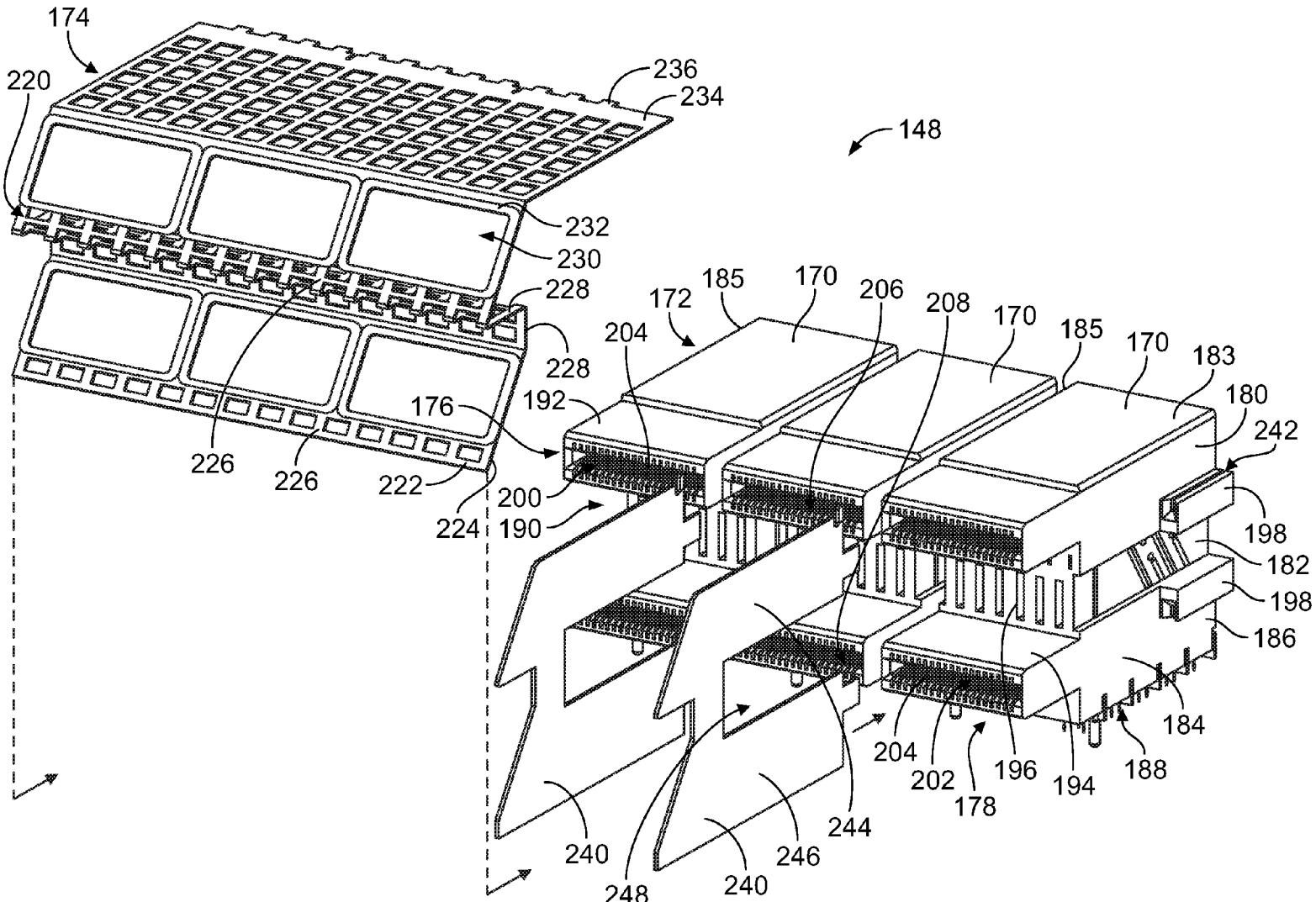
FIG. 4 is an exploded view of the connector module assembly shown in FIG. 3.

FIG. 3 is a front perspective view of the connector module assembly 148 in accordance with an exemplary embodiment. FIG. 4 is an exploded view of the connector module assembly 148. The connector module assembly 148 includes a plurality of communication connectors 170 ganged together to form a communication module 172. The communication connectors 170 are configured to interface with the pluggable modules 106 (shown in FIG. 2) when the pluggable modules 106 are coupled to the connector module assembly 148. The connector module assembly 148 includes a gasket plate 174 coupled to the communication module 172. The gasket plate 174 provides EMI shielding for the connector module assembly 148. The gasket plate 174 is configured to interface with the pluggable modules 106 when the pluggable modules 106 are coupled to the connector module assembly 148.

In an exemplary embodiment, each communication connector 170 has first and second mating interfaces 176, 178 for interfacing with different pluggable modules 106; however the communication connectors 170 may include a single mating interface or more than two mating interfaces in alternative embodiments. The first mating interface 176 is configured to be disposed within the upper module cavity 120 (shown in FIG. 1), and the second mating interface 178 is configured to be disposed within the lower module cavity 122 (shown in FIG. 1). Thus, in the illustrated embodiment, a single communication connector 170 may mate with two pluggable modules 106.

The communication connector 170 includes a housing 180 configured to hold one or more contact modules 181. The housing 180 is defined by an upstanding body portion 182 having a top 183, first and second sides 184, 185, a rear 186, a mounting face 188 configured to be mounted to the circuit board 102 (shown in FIG. 1), and a mating face 190 opposite the rear 186. Upper and lower shrouds 192 and 194 extend from the body portion 182 to define a stepped mating face 190. For example, the shrouds 192, 194 and a recessed face 196 between the shrouds 192, 194 may define the mating face 190 of the body portion 182. The shrouds 192, 194 may be generally box-shaped extensions. The shrouds 192, 194 may have other surfaces to have other shapes in alternative embodiments. For a single port cage member, the communication connector 170 may only include a single extension portion. The body portion 182 and shrouds 192, 194 may be co-molded from a dielectric material, such as a plastic material, to form the housing 180.

In an exemplary embodiment, the housing 180 includes alignment features 198 extending from the sides 184, 185. The alignment features 198 may interact with each other and/or other components to align adjacent housings 180. For example, the housings 180 may be stacked side-by-side with the corresponding alignment features 198 aligned and configured to be secured together to gang the communication connectors 170 together as the communication module 172.

Receiving slots 200 and 202 extend inwardly from the mating face 190 of each of the respective upper and lower shrouds 192, 194, and extend inwardly to the body portion 182. The receiving slots 200, 202 are configured to receive card edges of the circuit boards 158 (shown in FIG. 2) of the corresponding pluggable modules 106. A plurality of contacts 204 are held by the housing 180 and are exposed within the receiving slots 200, 202 for mating with the corresponding pluggable module 106. The contacts 204 and receiving slots 200, 202 define portions of the first and second mating interfaces 176, 178. Optionally, the contacts 204 may be parts of the contact modules 181 stacked together and loaded into the housing 180 through the rear 186. Alternatively, the contacts 204 may be individual contacts stitched into the housing 180 or otherwise loaded into the housing 180. The contacts 204 are arranged to define an upper contact array 206 and a lower contact array 208. The contact arrays 206, 208 may include any number of the contacts 204. The contacts 204 may be signal contacts, ground contacts or other types of contacts and the arrays 206, 208 may have the contacts 204 in any arrangement, such as a ground-signal-signal-ground arrangement with a pair of signal contacts flanked by ground contacts.

The contacts 204 extend from the mounting face 188 for termination to the circuit board 102. For example, ends of the contacts 204 may constitute pins that are loaded into plated vias of the circuit board 102. Alternatively, the contacts 204 may be terminated to the circuit board 102 in another manner, such as by surface mounting to the circuit board 102.

The upper and lower shrouds 192, 194, receiving slots 200, 202 and contacts 204 may define identical mating interfaces 176, 178 such that the mating interfaces 176, 178 are configured to mate with any pluggable module (for example, any pluggable module 106 may be plugged into the upper module cavity 120 or the lower module cavity 122 for connection to the communication connector 170). In the illustrated embodiment, each communication connector 170 has the upper contact array 206 arranged within the upper shroud 192 at the mating interface 176 configured for mating with a corresponding pluggable module 106, and each communication connector 170 has the lower contact array 208 arranged within the lower shroud 194 at the mating interface 178 configured for mating with a corresponding pluggable module 106. The upper and lower mating interfaces 176, 178 are in a stacked arrangement.

The gasket plate 174 is formed from a conductive material, such as sheet metal. In the illustrated embodiment, the gasket plate 174 is stamped and formed from sheet metal. In some embodiments, the gasket plate 174 is configured to facilitate airflow therethrough, such as through airflow openings sized small enough such that the gasket plate 174 provides effective EMI shielding. The gasket plate 174 includes one or more sheets 220 configured to provide EMI shielding for the mating interface between the pluggable modules 106 and the communication module 172. In an exemplary embodiment, the sheets 220 of the gasket plate 174 provide EMI shielding for all of the pluggable modules 106 and corresponding mating interfaces 176, 178 of the communication connectors 170. The gasket plate 174 is configured to directly contact the panels or sheets of the housing 108 to electrically common the gasket plate 174 and the housing 108. The gasket plate 174 includes an exterior or front side 222 and an interior or rear side 224. The front side 222 faces the pluggable modules 106. The rear side 224 faces the communication module 172.

In an exemplary embodiment, the gasket plate 174 includes one or more mating sheets 226 and one or more transition sheets 228 extending between or from corresponding mating sheets 226. The mating sheets 226 are configured to be mated with the pluggable modules 106. In the illustrated embodiment, the gasket plate 174 includes upper and lower mating sheets 226 configured for mating with pluggable modules 106 in the upper and lower module cavities 120, 122, respectively. The upper and lower mating sheets 226 include upper and lower openings 230 therethrough that receive corresponding shrouds 192, 194. In an exemplary embodiment, the upper and lower mating sheets 226 are angled (for example, non-vertical), which may accommodate the angled mating ends 152 (shown in FIG. 2) of the pluggable modules 106. Alternatively, the upper and lower mating sheets 226 may be substantially vertical and perpendicular to the mating axis. In an exemplary embodiment, the mating sheets 226 and/or transition sheets 228 span vertically between the upper and lower openings 230. In an exemplary embodiment, the mating sheets 226 and/or transition sheets 228 span horizontally between the various openings 230 (for example, between the adjacent openings 230 that receive shrouds 192, or 194 of different communication connectors 170. The mating sheets 226 and/or the transition sheets 228 include airflow openings that allow airflow through the gasket plate 174. Optionally, the airflow openings may allow airflow vertically through the receptacle assembly 104, such as from the pluggable module 106 and shroud 194 associated with the lower port 123 to the pluggable module 106 and shroud 192 associated with the upper port 121.

In an exemplary embodiment, the gasket plate 174 has pluggable module interfaces 232 at the front side 222 around the openings 230. The pluggable module interfaces 232 are configured to interface with mating ends 152 (shown in FIG. 2) of the pluggable modules 106. For example, the pluggable module interfaces 232 may be angled to mate with the angled mating ends 152 of the pluggable modules 106. In an exemplary embodiment, the pluggable module interfaces 232 are gaskets and may be referred to hereinafter as gaskets 232; however other types of interfaces may be provided in alternative embodiments. The gaskets 232 may be compressible. The gaskets 232 may be conductive foam gaskets 232. The pluggable module interfaces 232 may be spring fingers or tabs bent forward from the mating sheets 226. The pluggable module interfaces 232 are conductive and provide an interface between the pluggable modules 106 and the mating sheets 226.

The transition sheets 228 transition between the mating sheets 226 and may be provided above and/or below the mating sheets 226. In the illustrated embodiment, the gasket plate 174 includes a vertical transition sheet 228 that extends from the lower mating sheet 226, and a horizontal transition sheet 228 that extends between the vertical transition sheet 228 and the upper mating sheet 226. As such, the bottom of the upper mating sheet 226 may be positioned forward of the top of the lower mating sheet 226 to accommodate the angled mating sheets 226. The vertical transition sheet 228 may face and/or abut against the recessed face 196. Other transition sheets 228 may be provided in alternative embodiments.

In an exemplary embodiment, the gasket plate 174 includes a top sheet 234 extending rearward from the top of the upper mating sheet 226. The top sheet 234 extends along the top 183 of the housing 180. The top sheet 234 provides EMI shielding along the top 183. The top sheet 234 may engage other panels of the receptacle housing 108 (shown in FIG. 1), such as the back wall 146, to electrically connect the gasket plate 174 to the receptacle housing 108. For example, the top sheet 234 may include grounding portions 236 configured to mechanically and electrically couple to the conductive panels of the receptacle housing 108. The grounding portions 236 may be deflectable spring beams. The grounding portions 236 may be tabs configured to be folded over to lock to the corresponding panel of the receptacle housing 108. The grounding portions 236 may be mechanically and electrically connected to the panel by other means or processes in alternative embodiments.

In an exemplary embodiment, the communication module 172 includes separator panels 240 between various communication connectors 170. The separator panels 240 provide electrical shielding between the communication connectors 170. In an exemplary embodiment, the separator panels 240 are electrically connected to the gasket plate 174, such as by a direct, physical engagement therewith. The separator panels 240 may be interior panels of the receptacle housing 108.

Optionally, the separator panels 240 are positioned between the communication connectors 170 to fix the relative positions of the communication connectors 170 within the communication module 172 and to tie the housings 180 of the adjacent communication connectors 170 together. For example, the separator panels 240 may be received in the alignment features 198 extending from the sides 184, 185 of the housings 180. In an exemplary embodiment, the alignment features 198 on the first side 184 are positioned toward the rear 186 while the alignment features 198 on the second side 185 (shown in FIG. 8) are positioned toward the mating face 190. As such, when the housings 180 are stacked adjacent each other, the alignment features 198 are staggered front to back to receive the corresponding separator panels 240. The housings 180 may be stacked side-by-side with the corresponding alignment features 198 aligned and configured to be secured together by the separator panels 240 to gang the communication connectors 170 together as the communication module 172.

The alignment features 198 include slots 242 that receive the separator panels 240. The slots 242 of the alignment features 198 of the adjacent communication connectors 170 are aligned to define tracks that receive corresponding separator panels 240. In the illustrated embodiment, the housing 180 includes upper and lower alignment features 198 having slots 242 facing in opposite directions (for example, away from each other). Each separator panel 240 includes an upper leg 244 and a lower leg 246 with a space 248 therebetween. The upper leg 244 is received in the slots 242 of the upper alignment features 198 while the lower leg is received in the slots 242 of the lower alignment features 198. Other arrangements are possible in alternative embodiments.

Figure 5:
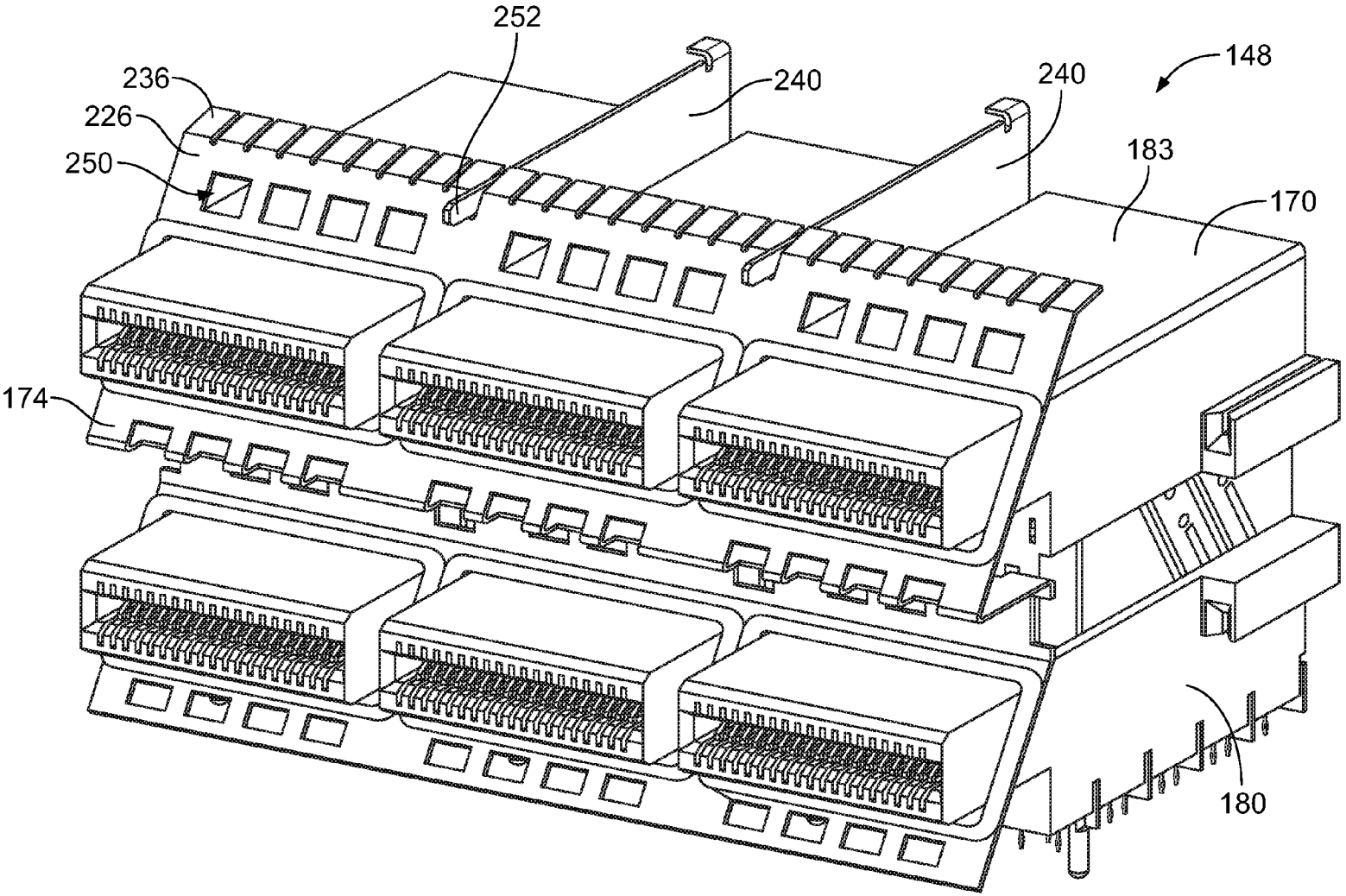
FIG. 5 is a front perspective view of the connector module assembly shown in FIG. 3.

FIG. 5 is a front perspective view of the connector module assembly 148 in accordance with an exemplary embodiment. The connector module assembly 148 illustrated in FIG. 5 is similar to the embodiment illustrated in FIG. 4; however, the gasket plate 174 does not include the top sheet, but rather, the grounding portions 236 extend from the top end of the upper mating sheet 226. The grounding portions 236, in the illustrated embodiment, are spring fingers and may be referred to hereinafter as spring fingers 236. The spring fingers 236 are configured to be deflected against the top panel of the receptacle housing 108 (shown in FIG. 1) to create a mechanical and electrical connection with the receptacle housing 108.

In the illustrated embodiment, the upper mating sheet 226 extends beyond the top 183 of the housing 180 of the communication connector 170. Airflow openings 250 are provided in the mating sheet 226 to allow airflow through the gasket plate 174. Such airflow openings 250 may be aligned with the airflow channels 124 (shown in FIG. 1) in the module cavity 120 to allow airflow through the gasket plate 174. Airflow openings 250 may be provided at other locations in the gasket plate 174.

In an exemplary embodiment, the separator panels 240 may include mating tabs 252 extending forward therefrom. The mating tabs 252 are configured to extend through the gasket plate 174, such as through dedicated slots in the gasket plate 174. The mating tabs 252 may be held in the gasket plate 174 by an interference fit to ensure mechanical and electrical connection between the separator panels 240 and the gasket plate 174.

Figure 6:
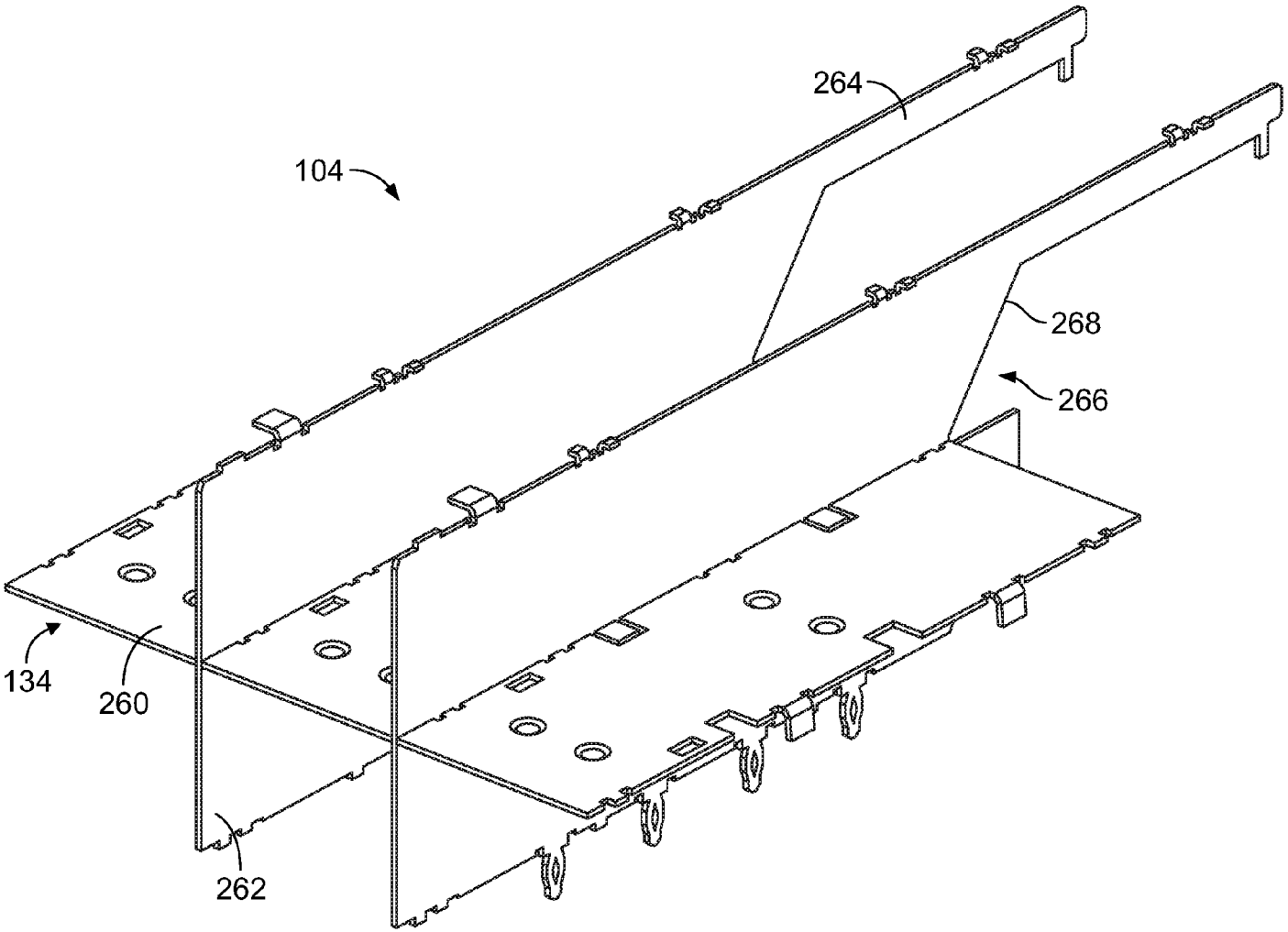
FIG. 6 is a perspective view of a portion of a receptacle assembly of the communication system shown in FIG. 1.

FIG. 6 is a perspective view of a portion of the receptacle assembly 104 showing the interior panels 134 of the receptacle housing 108. The interior panels 134 may be stamped and formed panels. The interior panels 134 may be coupled together, such as using tabs or other connecting features. The interior panels 134 include horizontal panels 260 and vertical panels 262. The horizontal panels 260 separate upper module cavities 120 (shown in FIG. 1) from lower module cavities 122 (shown in FIG. 1). The vertical panels 262 separate columns of module cavities 120, 122 from each other.

In an exemplary embodiment, the vertical panels 262 include arms 264 at the rear ends of the interior panels 134. The arms 264 are configured to engage the back wall 146 (shown in FIG. 1) and/or the top wall 140 (shown in FIG. 1) of the receptacle housing 108 (shown in FIG. 1). The arms may extend along the communication connectors 170 (shown in FIG. 3). The vertical panels 262 include notches 266 at rear edges 268 thereof. The notches 266 are configured to receive the gasket plate 174 (shown in FIG. 3). Optionally, the rear edges 268 may engage the gasket plate 174 to electrically connect the gasket plate 174 to the interior panels 134.

Figure 7:
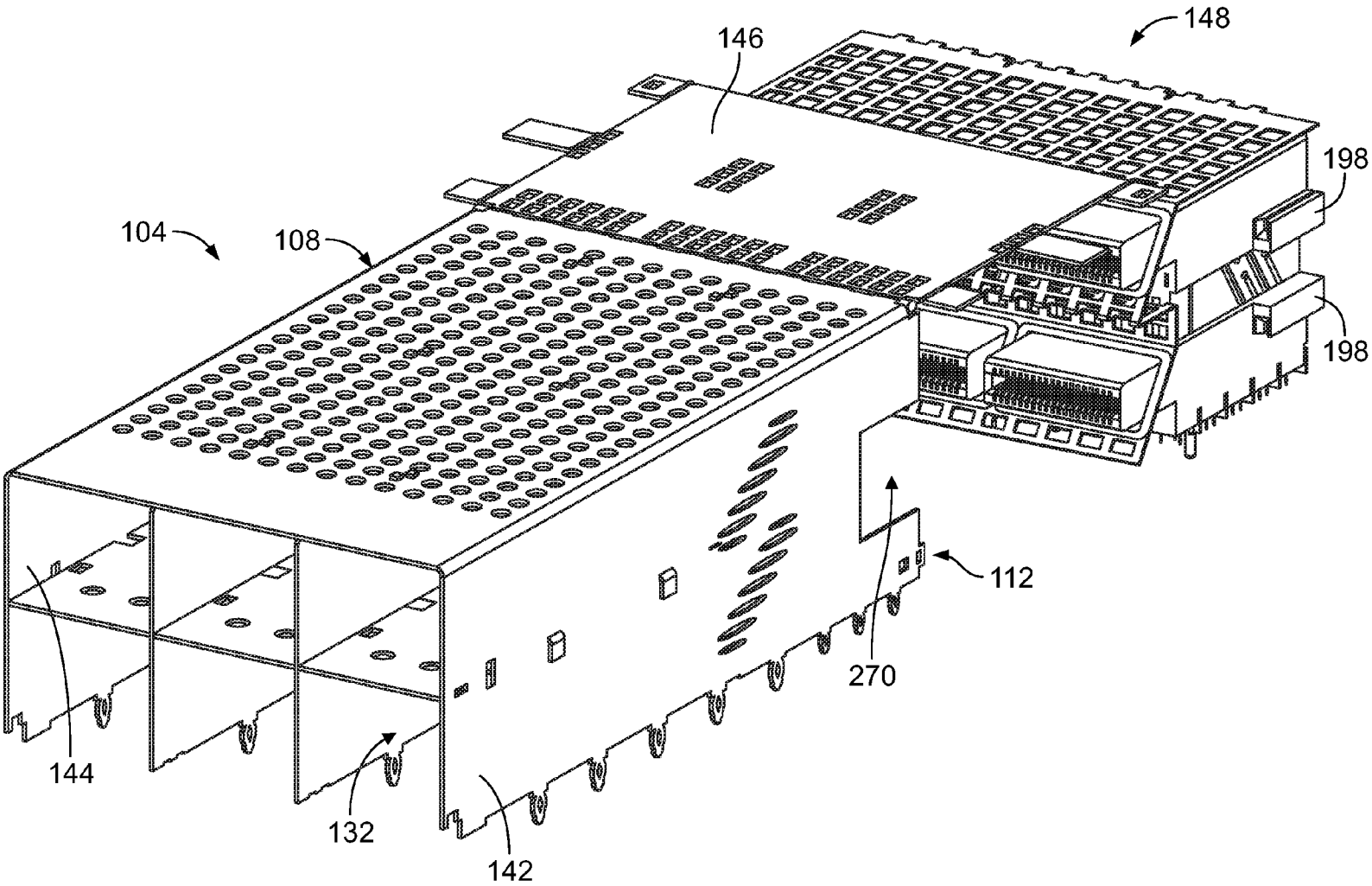
FIG. 7 is a front perspective view of the receptacle assembly showing a receptacle housing thereof in a partially assembled state and showing the connector module assembly poised for loading into the receptacle housing.

FIG. 7 is a front perspective view of the receptacle assembly 104 showing the receptacle housing 108 in a partially assembled state and showing the connector module assembly 148 poised for loading into the receptacle housing 108. In the illustrated embodiment, the connector module assembly 148 is configured to be rear loaded into the housing cavity 132 through the back end 112 of the receptacle housing 108. After the connector module assembly 148 is loaded into the receptacle housing 108, the back wall 146 may be closed behind the connector module assembly 148 and secured to the sidewalls 142, 144. In other various embodiments, the connector module assembly 148 may be loaded in through the bottom of the receptacle housing 108.

In an exemplary embodiment, the sidewalls 142, 144 include openings 270 at the back end 112 (or at the bottom in embodiments where the connector module assembly 148 is loaded in from the bottom). The openings 270 receive the alignment features 198 to position and/or secure the connector module assembly 148 in the housing cavity 132. Optionally, the openings 270 may be sized, shaped or positioned differently.

Figure 8:
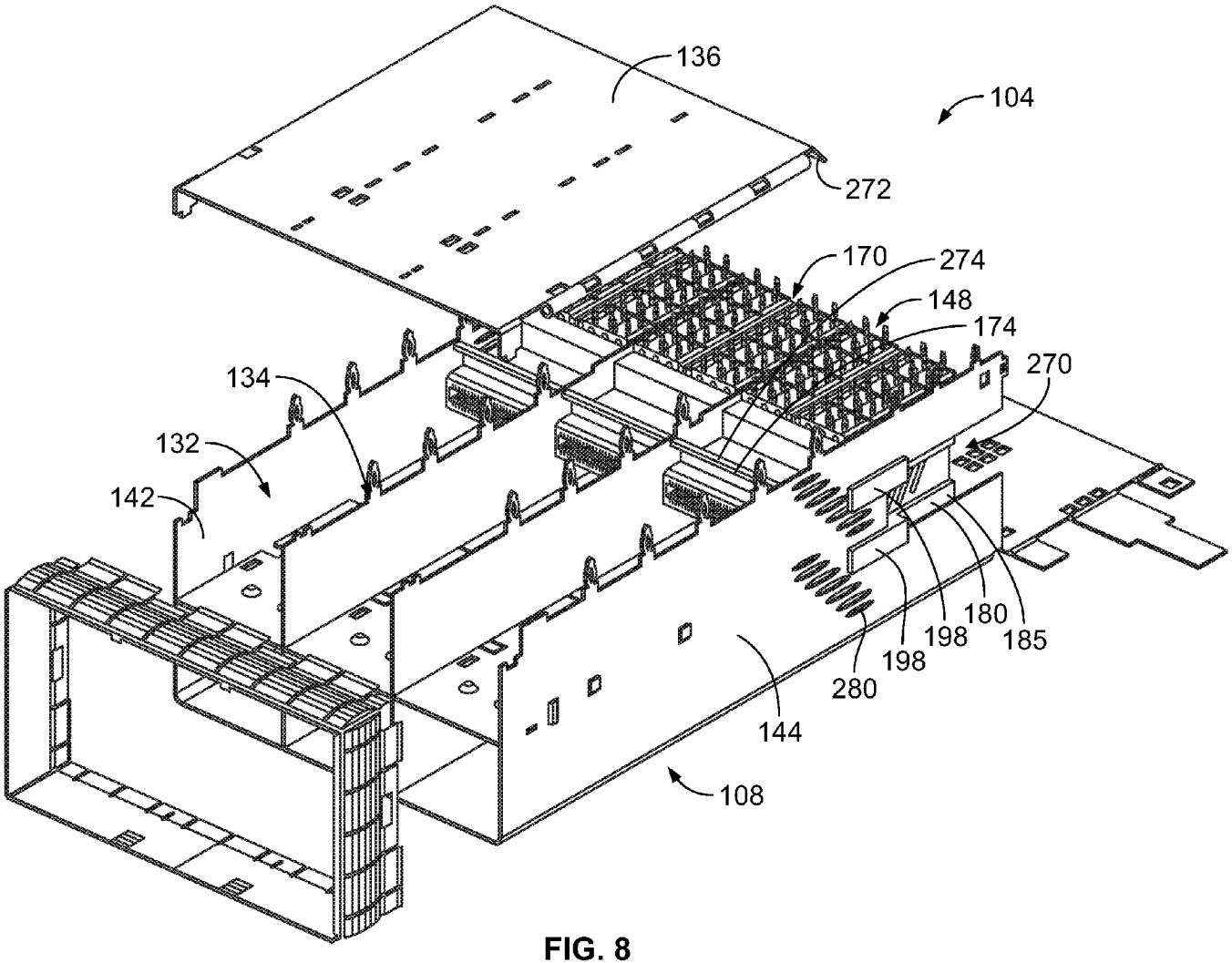
FIG. 8 is a bottom perspective view of the receptacle assembly showing a base panel poised for coupling to the receptacle housing.
Figure 9:
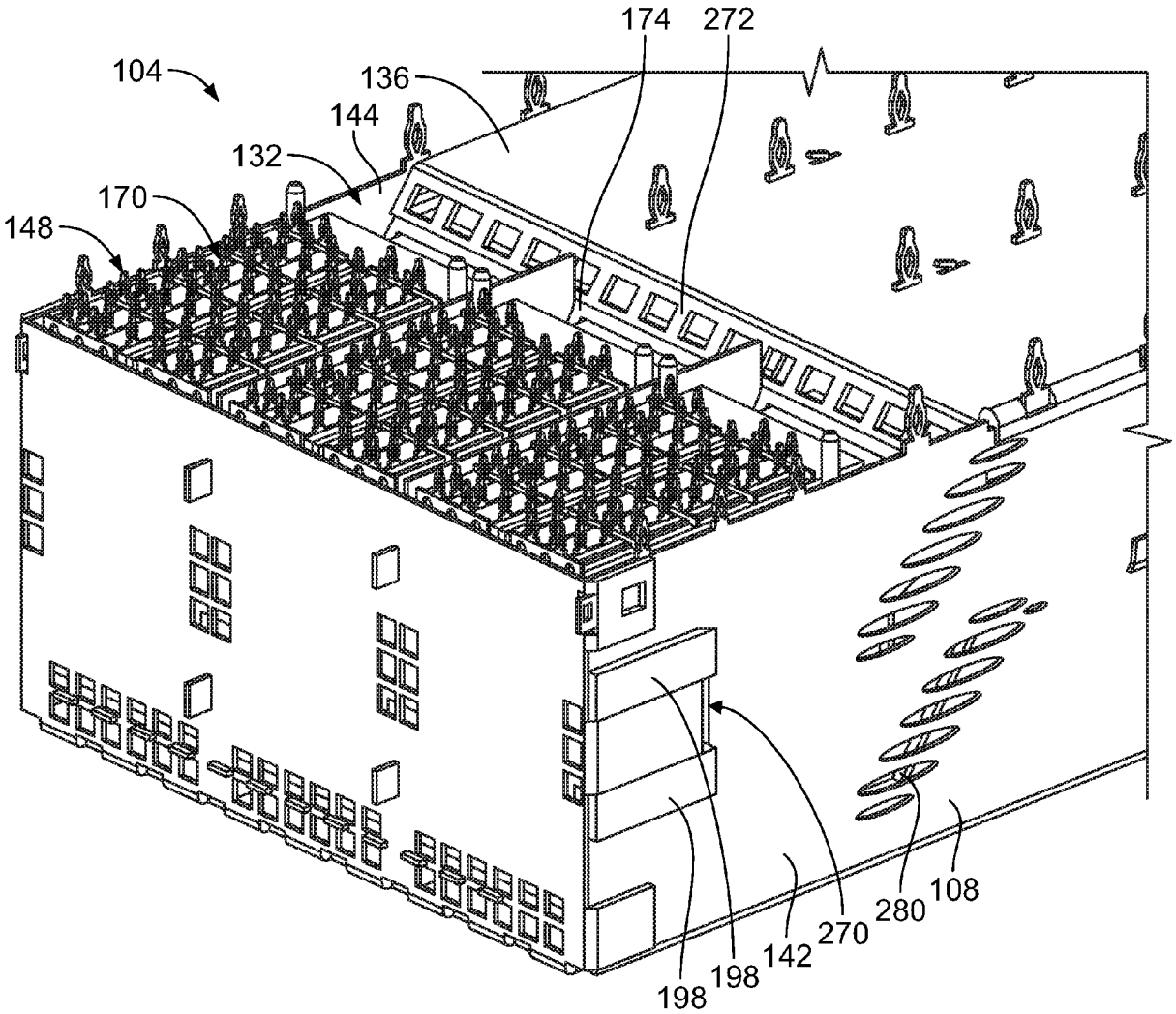
FIG. 9 is a bottom perspective view of the receptacle assembly showing the base panel in an assembled state.

FIG. 8 is a bottom perspective view of the receptacle assembly 104 showing the base panel 136 poised for coupling to the receptacle housing 108. FIG. 9 is a bottom perspective view of the receptacle assembly 104 showing the base panel 136 in an assembled state. The connector module assembly 148 is shown loaded into the receptacle housing 108. The alignment features 198 are received in the openings 270 to secure the housings 180 of the communication connectors 170 to the receptacle housing 108. During assembly, the base panel 136 is coupled to the bottom edges of the sidewalls 142, 144 and the interior panels 134. A rear flange 272 of the base panel 136 is configured to be aligned with and mated to a bottom edge 274 (FIG. 8) of the gasket plate 174. For example, the rear flange 272 may be soldered or welded to the gasket plate 174. Alternatively, the rear flange 272 may be mechanically secured thereto by an interference fit. In other various embodiments, tabs or other connecting features may be used to mechanically and electrically connect the base panel 136 to the gasket plate 174.

In an exemplary embodiment, the receptacle housing 108 includes grounding portions 280 extending into the housing cavity 132 from the sidewalls 142, 144. The grounding portions 280 may be stamped from the sidewalls 142, 144 and bent inward into the housing cavity 132 leaving openings along the sidewalls 142, 144. The openings left behind from stamping and forming the grounding portions 280 may be sufficiently small to prevent EMI leakage through the sidewalls 142, 144. For example, the openings may be long and narrow, which allows the grounding portions 280 to be elongated. The grounding portions 280 are configured to interface with the gasket plate 174 for electrical connection between the receptacle housing 108 and the gasket plate 174. The grounding portions 280 may be angled to match the angle of the gasket plate 174. In an exemplary embodiment, the grounding portions 280 are deflectable and flexible to allow mating with the gasket plate 174. Optionally, the grounding portions 280 may be spring beams that are elastically deformed against the gasket plate 174 to ensure that the grounding portions 280 maintain contact with the gasket plate 174.

Figure 10:
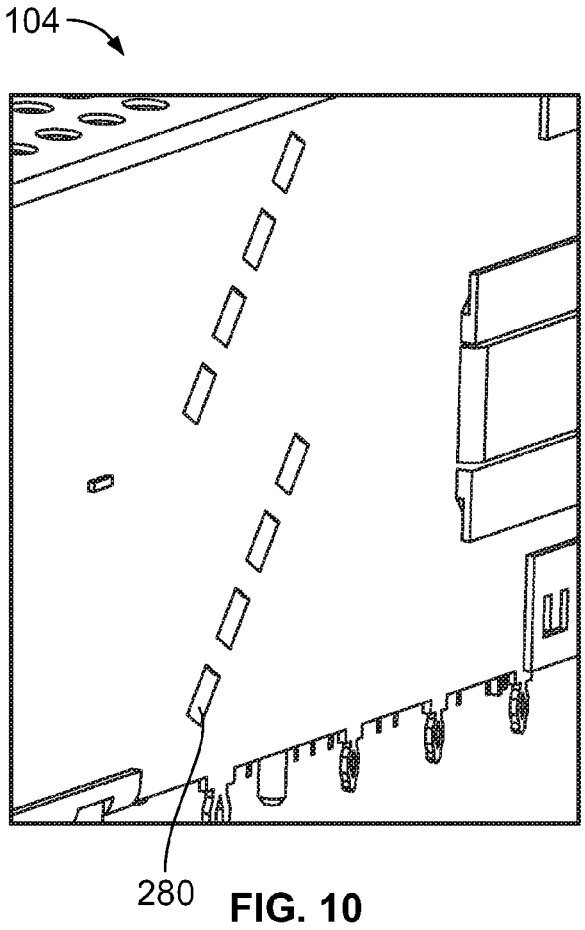
FIG. 10 is a perspective view of a portion of the receptacle assembly in an assembled state.

FIG. 10 is a perspective view of a portion of the receptacle assembly 104 in an assembled state. FIG. 10 illustrates the grounding portions 280 as having a different shape than the embodiment shown in FIGS. 8 and 9. The grounding portions 280 shown in FIG. 10 are shorter. The grounding portions 280 are flaps folded inward. The flaps may be angled to match the angle of the gasket plate 174 (shown in FIG. 3). The flaps are deflectable, such as to allow the gasket plate 174 to pass the grounding portions 280 such that the grounding portions 280 may be captured behind the gasket plate 174.

Figure 11:
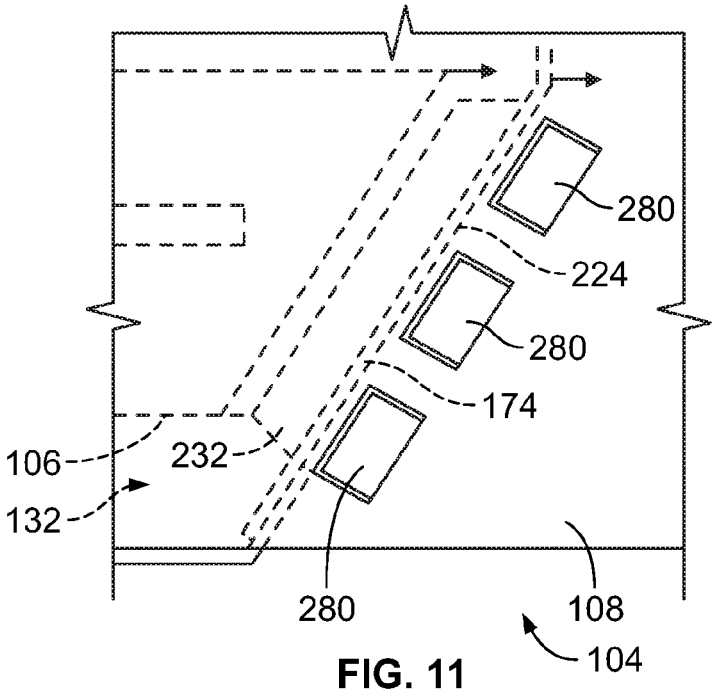
FIG. 11 is a side view of a portion of the receptacle assembly showing a gasket plate of the connector module assembly in phantom.

FIG. 11 is a side view of a portion of the receptacle assembly 104 showing the grounding portions 280 interacting with the gasket plate 174 (shown in phantom). The pluggable module 106 (shown in phantom) is shown being mated with the gasket plate 174. When the gasket plate 174 is loaded into the receptacle housing 108, the gasket plate 174 is loaded forward until the gasket plate clears the grounding portions 280. The grounding portions 280 are positioned rearward of the rear side 224 of the gasket plate 174. Optionally, the gasket plate 174 may engage the grounding portions 280; however, the gasket plate 174 may be spaced slightly forward of the grounding portions 280.

In an exemplary embodiment, the gasket plate 174 is movable relative to the receptacle housing 108. For example, the gasket plate 174 may float within the housing cavity 132 from a forward position to a rearward position. Optionally, the grounding portions 280 may engage the gasket plate 174 in both the forward and the rearward positions. Alternatively, the gasket plate 174 may only contact the grounding portions 280 when moved to the rearward position. In an exemplary embodiment, the gasket plate 174 is movable to allow mating with the pluggable module 106, even when the pluggable module 106 is not fully loaded (for example, the pluggable module 106 may not be fully seated into the receptacle housing 108 but still electrically connected to the communication connector 170 (shown in FIG. 3) and thus operational). The gasket plate 174 may be positioned forward to ensure that the gasket plate 174 and the gasket 232 engage the pluggable module 106 even in the partially loaded position. However, as the pluggable module 106 is loaded into the receptacle housing 108, the pluggable module 106 may seat against the gasket 232 and further loading of the pluggable module 106 causes the gasket plate 174 to float rearward. In an exemplary embodiment, the grounding portions 280 are deflectable to accommodate the floating movement of the gasket plate 174, such as in the mating direction, to the rearward position. As the gasket plate 174 moves rearward, the grounding portions 280 are deflected rearward in engagement with the gasket plate 174. As such, a reliable electrical connection is made between the receptacle housing 108 and the gasket plate 174. The grounding portions 280 may define a positive stop for the gasket plate 174 as the gasket plate 174 is pressed rearward by the pluggable module 106.

Figure 12:
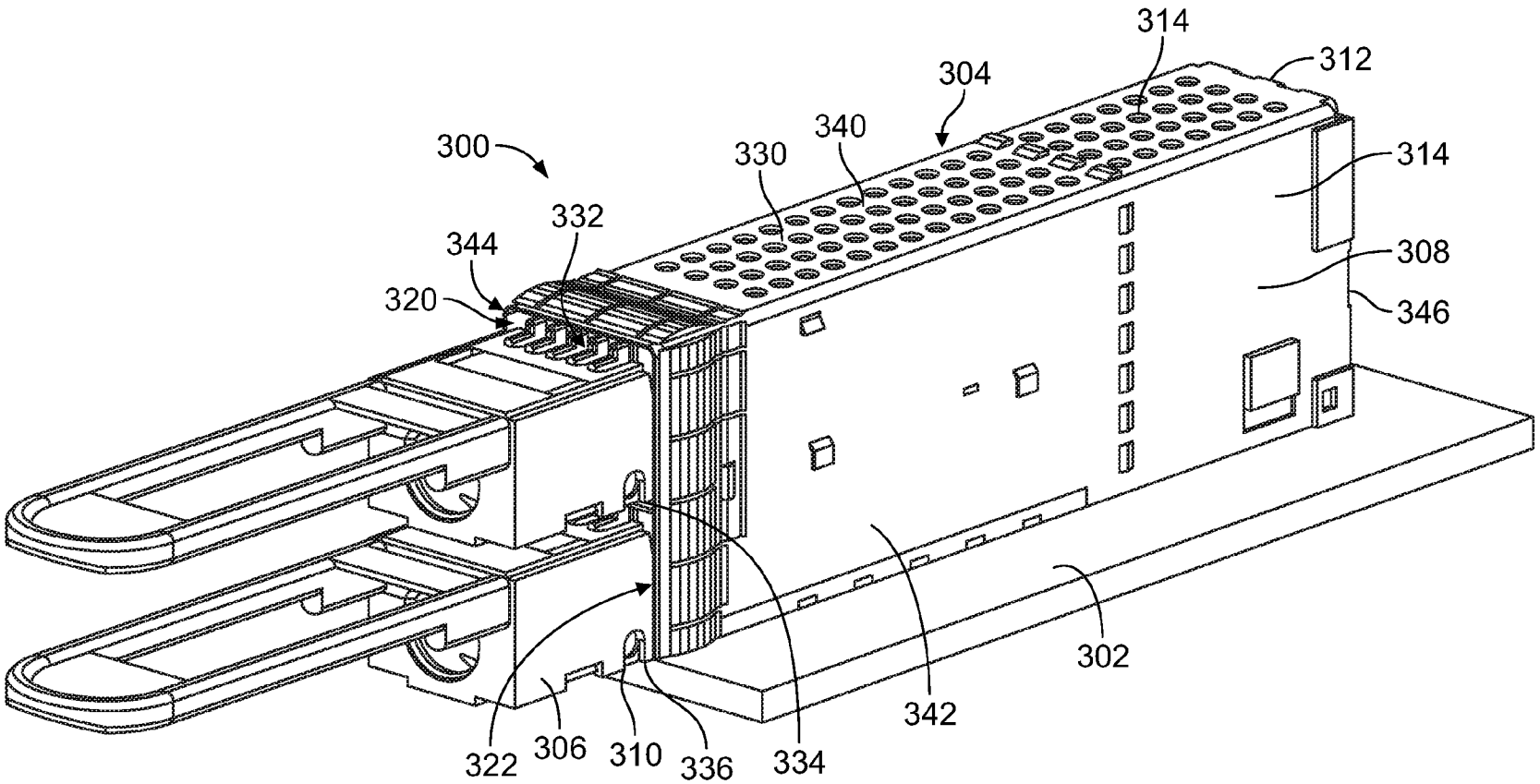
FIG. 12 is a perspective view of a communication system in accordance with an embodiment.

FIG. 12 is a perspective view of a communication system 300 in accordance with an embodiment. The communication system 300 may include a circuit board 302, a receptacle assembly 304 mounted to the circuit board 302, and one or more pluggable modules 306 that are configured to communicatively engage the receptacle assembly 304. The communication system 300 is similar to the communication system 100 shown in FIG. 1; however, the pluggable modules 306 are shaped differently than the pluggable modules 106 and some features of the receptacle assembly 304 are shaped or oriented differently, such as to accommodate the pluggable modules 306.

The receptacle assembly 304 includes a receptacle housing 308 that is mounted to the circuit board 302. The receptacle housing 308 may also be referred to as a receptacle cage. The receptacle housing 308 includes a front end 310 and an opposite back end 312. The front end 310 may be provided at, and extend through an opening in, the faceplate. The receptacle housing 308 is configured to contain or block electromagnetic interference (EMI) and guide the pluggable module(s) 306 during a mating operation. The receptacle housing 308 includes a plurality of conductive housing walls 314 that are interconnected with one another to form the receptacle housing 308.

In the illustrated embodiment, the receptacle housing 308 includes a first (or upper) module cavity 320 and a second (or lower) module cavity 322; however the receptacle housing 308 may have multiple cavities 320, 322 in rows similar to the receptacle housing 108. The receptacle housing 308 is formed from a plurality of interconnected panels or sheets. For example, the receptacle housing 308 includes a main panel or shell 330 that surrounds a housing cavity 332, one or more interior panels 334 and a base panel 336. In an exemplary embodiment, the main panel 330 includes a top wall 340, sidewalls 342, 344, and a back wall 346 formed integral with each other; however any of such walls may be separate and coupled to the other walls. The interior panels 334 are configured to be positioned within the housing cavity 332. The interior panels 334 apportion or divide the housing cavity 332 into the separate module cavities 320, 322.

The receptacle assembly 304 includes a connector module assembly 348 (shown in FIG. 14) at the back end 312. The pluggable module(s) 306 is mated with the connector module assembly 348. In an exemplary embodiment, EMI shielding is provided at the connector module assembly to provide electrical shielding at the interface with the pluggable modules 306.

Figure 13:
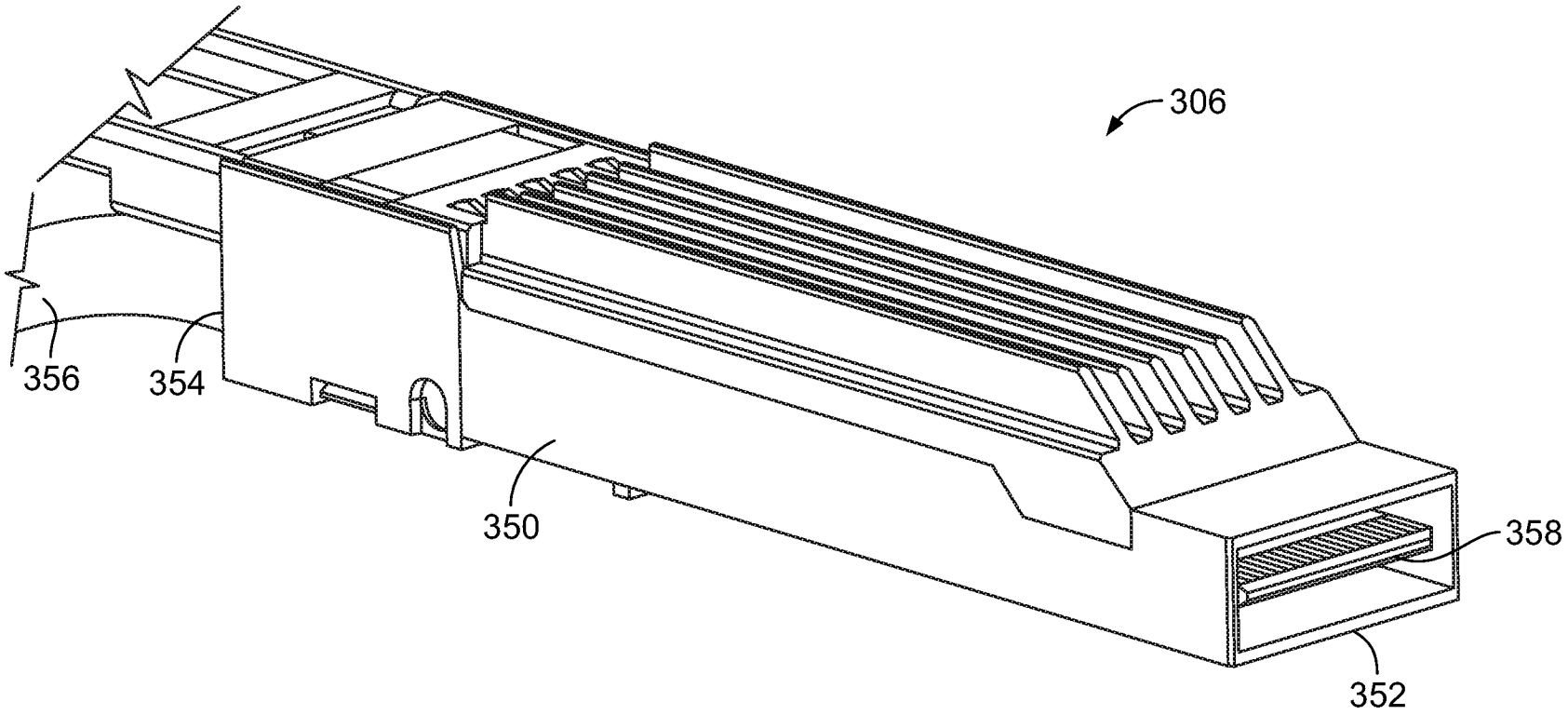
FIG. 13 is a perspective view of a pluggable module for the communication system shown in FIG. 12 in accordance with an exemplary embodiment.

FIG. 13 is a perspective view of the pluggable module 306 in accordance with an exemplary embodiment. In some embodiments, the pluggable module 306 is an input/output cable assembly having a pluggable body 350. The pluggable body 350 includes a mating end 352 and an opposite cable end 354. A cable 356 is coupled to the pluggable body 350 at the cable end 354. The pluggable body 350 also includes an internal circuit board 358 that is communicatively coupled to electrical wires or optical fibers (not shown) of the cable 356. The internal circuit board 358 may be exposed at the mating end 352 for mating with the connector module assembly 348 (shown in FIG. 3). In the illustrated embodiment, the mating end 352 is flat, as opposed to be angled as in the embodiment illustrated in FIG. 2. For example, the mating end 352 may be oriented vertically.

Figure 14:
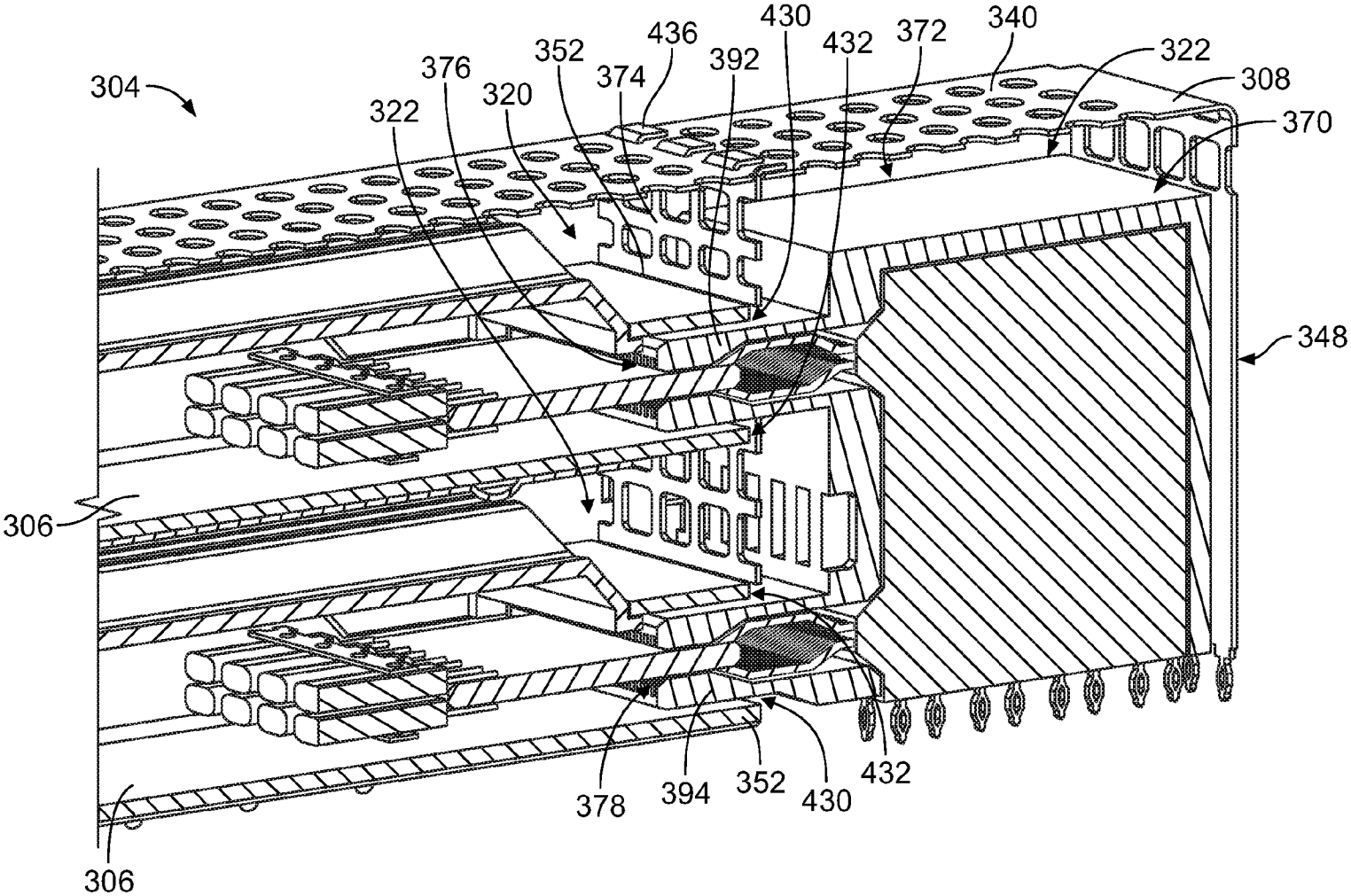
FIG. 14 is a partial sectional view of a connector module assembly for the communication system shown in FIG. 12 in accordance with an exemplary embodiment.

FIG. 14 is a partial sectional view of the connector module assembly 348 in accordance with an exemplary embodiment. The connector module assembly 348 includes a communication connector 370; however various embodiments may include a plurality of communication connectors 370 ganged together to form a communication module. The communication connector 370 is configured to interface with the pluggable modules 306 when the pluggable modules 306 are coupled to the connector module assembly 348. The connector module assembly 348 includes a gasket plate 374 coupled to the communication connector(s) 370. The gasket plate 374 provides EMI shielding for the connector module assembly 348. The gasket plate 374 is configured to interface with the pluggable modules 306 when the pluggable modules 306 are coupled to the connector module assembly 348.

In an exemplary embodiment, the communication connector 370 has first and second mating interfaces 376, 378 for interfacing with different pluggable modules 306. The first mating interface 376 is configured to be disposed within the upper module cavity 320 and the second mating interface 378 is configured to be disposed within the lower module cavity 322.

The gasket plate 374 is formed from a conductive material, such as sheet metal. In the illustrated embodiment, the gasket plate 374 is stamped and formed from sheet metal. The gasket plate 374 is oriented vertically within the housing cavity 332 for interfacing with the flat mating ends 352 of the pluggable modules 306. In some embodiments, the gasket plate 374 is configured to facilitate airflow therethrough, such as through airflow openings sized small enough such that the gasket plate 374 provides effective EMI shielding. In an exemplary embodiment, the gasket plate 374 provides EMI shielding for all of the pluggable modules 306 and corresponding mating interfaces 376, 378 of the communication connector 370. The gasket plate 374 is configured to directly contact the panels or sheets of the housing 308 to electrically common the gasket plate 374 and the housing 308.

In an exemplary embodiment, the gasket plate 374 has gaskets 432 at the front side around openings 430. The gaskets 432 are configured to interface with the mating ends 352 of the pluggable modules 306. The gaskets 432 may be compressible. The gaskets 432 are conductive and provide an interface between the pluggable modules 306 and the gasket plate 374.

In an exemplary embodiment, the gasket plate 374 is coupled to the top wall 340 using grounding portions 436. The grounding portions 436 may be tabs configured to be folded over to interlock the gasket plate 374 and the receptacle housing 308.

Figure 15:
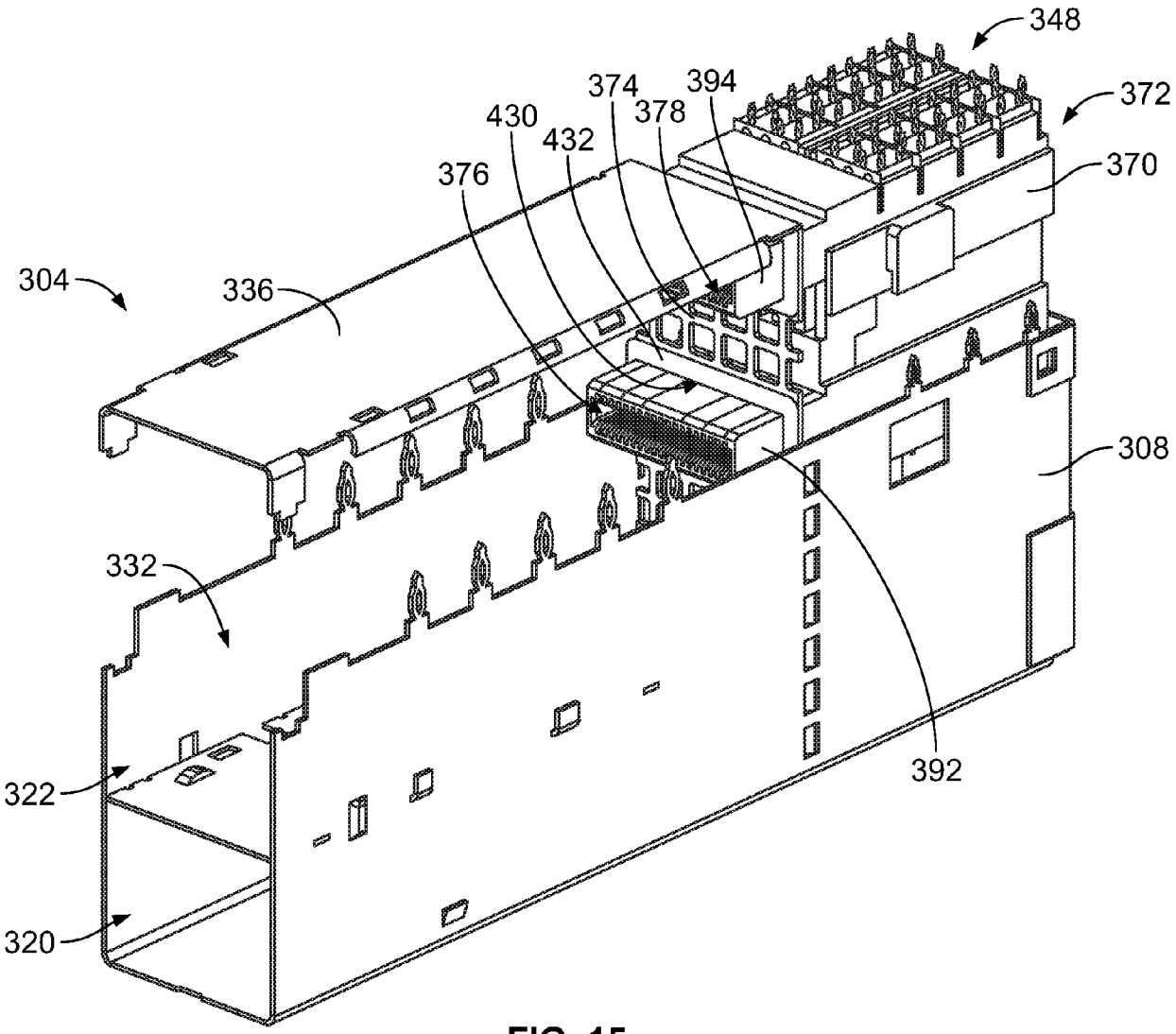
FIG. 15 is a bottom perspective view of a portion of a receptacle assembly for the communication system shown in FIG. 12 in accordance with an exemplary embodiment.

FIG. 15 is a bottom perspective view of a portion of the receptacle assembly 304 showing the receptacle housing 308 in a partially assembled state and showing the connector module assembly 348 partially loaded into the receptacle housing 308. In the illustrated embodiment, the connector module assembly 348 is configured to be bottom loaded into the housing cavity 332 through the bottom of the receptacle housing 308. In other various embodiments, the connector module assembly 348 may be loaded in through the back end of the receptacle housing 308.

During assembly, the gasket plate 374 is loaded over the front ends of the upper and lower shrouds 392, 394 of the communication connector 370. The gasket plate 374 spans across all of the ports 320, 322 to provide EMI shielding for the ports 320, 322 and corresponding pluggable modules 306. The gaskets 432 provide EMI shielding directly to the pluggable modules 306. The base panel 336 is coupled to the gasket plate 374, or alternatively may be integral with the gasket plate 374. The connector module assembly 348 is then loaded into the receptacle housing 308 and mechanically and electrically connected thereto. The gasket plate 374 allows airflow therethrough for cooling of the pluggable modules 306 and/or the communication connector 370.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A connector module assembly comprising:

a plurality of communication connectors arranged side-by-side and secured together as a communication module, each communication connector having a contact array arranged within a shroud at a mating interface, the shroud and the contact array being configured for mating with a corresponding pluggable module; and a gasket plate coupled to the communication module, the gasket plate having at least one sheet including a front side facing the pluggable modules and a rear side facing the communication module such that the gasket plate is generally positioned between the communication module and the pluggable modules, the at least one sheet spanning across and between each of the communication modules, the gasket plate having a plurality of openings receiving corresponding shrouds such that the shrouds pass through the openings for mating with the corresponding pluggable modules, the gasket plate having pluggable module interfaces around each of the openings for interfacing with mating ends of the pluggable modules associated with the corresponding openings, the gasket plate being conductive to provide electromagnetic interference (EMI) shielding at the pluggable module interfaces.

2. The connecter module assembly of claim 1, wherein the gasket plate is floatable relative to the communication module for mating with the pluggable modules.

3. The connector module assembly of claim 1, wherein the front side and the rear side of the at least one sheet are angled non-perpendicular with respect to the shrouds.

4. The connecter module assembly of claim 1, wherein each communication connector includes plural contact arrays and plural shrouds in a stacked arrangement defining an upper contact array in an upper shroud and a lower contact array in a lower shroud, the gasket plate having upper openings receiving corresponding upper shrouds and lower openings receiving corresponding lower shrouds.

5. The connecter module assembly of claim 4, wherein the at least one sheet spans vertically between the upper and lower openings and the at least one sheet spans horizontally between the upper and lower openings that receive shrouds of different communication connectors.

6. The connecter module assembly of claim 4, wherein the at least one sheet includes airflow openings allowing airflow between ports associated with the lower shroud and the upper shroud.

7. The connecter module assembly of claim 1, wherein the gasket plate includes grounding portions configured to be mechanically and electrically coupled to conductive panels of a receptacle housing.

8. The connecter module assembly of claim 7, wherein the grounding portions are spring fingers configured to be resiliently deflected against the corresponding panels.

9. The connecter module assembly of claim 1, wherein the communication connectors include housings holding the contact assemblies, the housings each include alignment features, the alignment features of adjacent communication connectors cooperating to align the housings relative to each other.

10. The connecter module assembly of claim 9, further comprising separator panels positioned between adjacent communication connectors, the separator panels engaging the alignment features of the adjacent communication connectors to secure the housings to the separator panels.

11. The connecter module assembly of claim 9, wherein the alignment features include slots, the slots of the alignment features of the adjacent communication connectors being aligned to define tracks, the tracks receiving corresponding separator panels positioned between the communication connectors to fix the relative positions of the communication connectors.

12. The connecter module assembly of claim 1, further comprising separator panels between the communication connectors, the gasket plate engaging the separator panels, the separator panels being conductive and being electrically connected to the gasket plate to provide EMI shielding between the communication connectors.

13. The connecter module assembly of claim 1, wherein the gasket plate includes a top sheet extending rearward therefrom over tops of the communication connectors to provide EMI shielding above the communication connectors.

14. A receptacle assembly comprising:

a receptacle housing having a plurality of panels defining a housing cavity, the plurality of panels including interior panels dividing the housing cavity into a plurality of module cavities each configured to receive a corresponding pluggable module therein, the module cavities being arranged in a plurality of rows and a plurality of columns, the panels being conductive to provide electromagnetic interference (EMI) shielding for the housing cavity; and a connector module assembly received in the housing cavity, the connector module assembly comprising:

a plurality of communication connectors arranged side-by-side and secured together as a communication module, each communication connector having a contact array arranged within a shroud at a mating interface, the shroud and the contact array being aligned with a corresponding module cavity and configured for mating with a corresponding pluggable module; and a gasket plate coupled to the communication module and positioned behind the interior panels, the gasket plate having at least one sheet including a front side facing the module cavities and a rear side facing the communication module such that the gasket plate is generally positioned between the communication module and the pluggable modules, the at least one sheet spanning across each of the module cavities, the at least one sheet spanning across and between each of the communication modules, the gasket plate having a plurality of openings aligned with corresponding module cavities and receiving corresponding shrouds such that the shrouds pass through the openings into the corresponding module cavities for mating with the pluggable modules, the gasket plate having pluggable module interfaces around each of the openings for interfacing with mating ends of the pluggable modules associated with the corresponding openings, the gasket plate being conductive to provide EMI shielding at the pluggable module interfaces, the gasket plate being mechanically and electrically connected to the receptacle housing.

15. The receptacle assembly of claim 14, wherein the gasket plate is floatable relative to the communication module for mating with the pluggable modules.

16. The receptacle assembly of claim 14, wherein the gasket plate includes grounding portions configured to be mechanically and electrically coupled to corresponding panels of the receptacle housing.

17. The receptacle assembly of claim 14, wherein the communication connectors include housings holding the contact assemblies, the housings each include alignment features, the alignment features of adjacent communication connectors cooperating to align the housings relative to each other.

18. The receptacle assembly of claim 17, further comprising separator panels positioned between adjacent communication connectors, the separator panels engaging the alignment features of the adjacent communication connectors to secure the housings to the separator panels.

19. The receptacle assembly of claim 14, wherein the connector module assembly is rear loaded into the housing cavity of the receptacle housing.

20. A communication system comprising:

pluggable modules each comprising a pluggable body extending between a mating end and a cable end, the pluggable module has an internal circuit board held in the pluggable body and provided at an end of a cable communicatively coupled to the internal circuit board; and a receptacle assembly having a receptacle housing mounted to a circuit board, the receptacle assembly comprises a receptacle housing and a connector module assembly received in the receptacle housing;

the receptacle housing having a plurality of panels defining a housing cavity, the plurality of panels including interior panels dividing the housing cavity into a plurality of module cavities receiving corresponding pluggable modules therein, the module cavities being arranged in a plurality of rows and a plurality of columns, the panels being conductive to provide electromagnetic interference (EMI) shielding for the housing cavity;

the connector module assembly having a plurality of communication connectors arranged side-by-side and secured together as a communication module, each communication connector having a contact array arranged within a shroud at a mating interface, the shroud and the contact array being aligned with a corresponding module cavity and mated with a corresponding pluggable module, and the connector module assembly having a gasket plate coupled to the communication module and positioned behind the interior panels, the gasket plate having at least one sheet including a front side facing the module cavities and a rear side facing the communication module such that the gasket plate is generally positioned between the communication module and the pluggable modules, the at least one sheet spanning across each of the module cavities, the at least one sheet spanning across and between each of the communication modules, the gasket plate having a plurality of openings aligned with corresponding module cavities and receiving corresponding shrouds such that the shrouds pass through the openings into the corresponding module cavities for mating with the pluggable modules, the gasket plate having pluggable module interfaces around each of the openings for interfacing with the mating ends of the pluggable modules, the gasket plate being conductive to provide EMI shielding at the pluggable module interfaces, the gasket plate being mechanically and electrically connected to the receptacle housing.

* * * * *